United States Patent [19]

Hurst

[11] Patent Number: 5,048,839

[45] Date of Patent: Sep. 17, 1991

[54] MEDIATED STRATEGY GAME

[76] Inventor: Mark P. Hurst, 7 Porter Rd., Annapolis, Md. 21402

[21] Appl. No.: 502,742

[22] Filed: Apr. 2, 1990

[51] Int. Cl.[5] ..... A63F 3/00

[52] U.S. Cl. ..... 273/240

[58] Field of Search ..... 273/236, 240, 283, 286, 273/287

[56] References Cited

U.S. PATENT DOCUMENTS

| | | | |
|---|---|---|---|
| 1,317,880 | 10/1919 | Lyman . | |
| 3,114,551 | 12/1963 | Ovitz . | |
| 3,254,893 | 6/1966 | Serviere . | |
| 3,343,841 | 9/1967 | Arend . | |
| 3,434,718 | 3/1969 | Estrin et al. . | |
| 3,547,441 | 12/1970 | Thornton . | |
| 3,591,182 | 7/1971 | Grubler | 273/240 X |
| 3,819,185 | 6/1974 | Lowther | 273/240 X |
| 3,941,385 | 3/1976 | Lalley . | |
| 4,188,034 | 2/1980 | Dempsey et al. . | |
| 4,232,864 | 11/1980 | Yaworsky . | |
| 5,000,460 | 3/1991 | Barbiaux et al. | 273/240 X |

OTHER PUBLICATIONS

Wilkes; *Barons*, R.A.W. Software, Ver. 2.00, 1989.

*Primary Examiner*—Edward M. Coven
*Assistant Examiner*—William E. Stoll
*Attorney, Agent, or Firm*—Nancy J. Linck

[57] ABSTRACT

Disclosed is a method and apparatus for the playing of a mediated war game by two or more players, called "Mitcrons", and a Mediator using a game apparatus which comprises at least two game pieces per player, called "Bots", and at least three transparent sheets having identical geographical maps permanently affixed thereon which are from time to time superimposed over each other so that the Mediator can record (1) each Mitcron's ordering of its Bot' moves toward a predetermined goal and blasts to destroy enemy Bots; and (2) spotting by each Mitcron of the other Mitcron's Bots.

12 Claims, 6 Drawing Sheets

MEDIATED STRATEGY GAME

Traditionally, games have required players to assemble together to play them. Some computer games have recently been developed which permit players who are separated by distances to play the same games together through the use of computer terminals, linked together through a master computer. The use of a computer permits information regarding all of the players' moves to be stored and certain information regarding individual players' moves to be transferred to the desired recipient(s).

The present invention provides a game which does not require a computer but yet permits players to play the game without assembling together. More specifically, the present invention relates to a method and apparatus for playing a strategic game called "Mitcron" which includes at least three transparent play sheets representative of a battlefield map. Three or more players may play the game without assembling together, with one of the three acting as a referee (the "Mediator") and the other two acting as team leaders ("Mitcrons"). Each player, including the Mediator, receives a map. The Mediator, using his transparent play sheet, serves a function analogous to that of a master computer in computer games played at a distance.

Each team is composed of two or more game pieces or robots ("Bots") which are ordered to move across the battlefield toward a predetermined goal by the team leaders. Each Mitcron's map has the position of that Mitcron's Bots affixed thereon using some predetermined symbol such as those illustrated in Table 1. The Mediator's map has the position of all of the Mitcrons' Bots affixed thereon which symbols further include an indication of the team to which the Bot belongs, for example, the symbols can be in different colors or can indicate different colors by using the first initial of the color.

In addition to the positions of the Bots, each map includes different types of terrain, for example, hills, woods, edge of woods, and clear. Hills can be represented by circles, and woods can be represented by curvy, irregularly shaped figures. The edge of woods is defined as the terrain exactly on the line delineating the woods, and the clear is the remaining portion of the map. Of course, other shapes could be used to represent hills and woods, etc., and other geographical symbols can be included, and such variations are intended to be included in the present invention. FIGS. 1 through 4*b* illustrate typical maps which can be used.

The actual playing of the game involves each Mitcron taking turns, not necessarily alternatively. Each turn can comprise the following four aspects:

(1) the Mitcron's "ordering" (a) one or more of its Bots to physically move across the battlefield map no more than a predetermined distance, for example 3 centimeters, or, alternatively, (b) two or more Bots to destroy an enemy Bot who is within a predetermined distance, for example 6 centimeters, by "blasting" (ordering is the strategic portion of the turn);

(2) the Mitcron's optionally preparing communications ("Diplomatic Correspondence" or "DC") to be sent to another Mitcron (the diplomatic portion of the turn);

(3) the Mediator's "processing" of the Mitcron's map upon which the Mitcron's ordering has been recorded by the Mitcron and of the Mitcron's DC; and (4) the Mediator's returning the Mitcron's map and transferring any DC previously sent to the Mitcron by another Mitcron.

Aspects (3) and (4) of each turn are each termed a "givetake". The number of givetakes per Mitcron permitted in any given period can be limited, for example, to three per day. In aspect (3), a Mitcron may submit his map to the Mediator without ordering his Bots to either move or blast, if only spotting is desired.

Ordering a Bot to physically move is conveniently accomplished by connecting the Bot's original position on the map (previously recorded with an erasable or removable marker) to its new position with an unbroken line. Ordering a pair of Bots to blast an enemy who is within a predetermined distance is conveniently accomplished by locating an enemy, either based on actual spotting or on guessing, and then connecting the position of each Bot of the pair of Bots ordered to blast to the position of the enemy Bot with a broken line.

The Mediator is the backbone of the game of Mitcron. Apart from taking care of the necessary duties involved in processing orders and DC, the Mediator is responsible for keeping the Mitcrons enthusiastic about the game. He can do this by writing background stories to each level, employing different characters and plots. Another duty the Mediator has is that of beginning each level. The first action of each level is that of the Mediator selecting and recording the initial positions of all the Bots on the Battlefield on the master map. The initial positions are selected in such a way that no team has any beginning advantage by the initial placement of its Bots. For example, in Level One, described below, each Bot is placed equidistant from the central objective. The Mediator then superimposes each player's map over the master map and records the positions of each of the player's Bots on that player's map. The level can officially begin (with the Mediator ready to accept the first order) when the Mediator gives the maps out to the players.

Processing by the Mediator comprises the following steps:

(i) Receiving the Mitcron's map and any DC, which DC is retained by the Mediator until the addressee takes a turn;

(ii) Determining the "legality" of the Mitcron's order by measuring the distances of the moves and blasts and by determining whether the Mitcron's Bots are still in the game and have not been blasted by enemy Bots. If a move is not within the allowed distance, the Bot is returned to its previous position. If a blast is not within the allowed distance, the blast is canceled. If a Bot has been previously blasted by an enemy Bot, it is erased from the Mitcron's map.

(iii) Recording the Mitcron's orders on the master map by superimposing the master map over the Mitcron's map to permit (a) recording the Mitcron's Bots' ne positions and erasing the previous positions, if one or more physical moves have been made; and (b) removing any enemy Bots which have been blasted.

(iv) Preparing the Mitcron's map to return to the Mitcron by superimposing the Mitcron's map over the master map to permit (a) recording any enemy Bots' positions which can be spotted from the Mitcron's Bots' new positions by affixing a symbol identifying the position of the enemy Bot and the team to which it belongs, but not necessarily the type of enemy Bot (for example, by identifying it by color only); and (b) erasing previous Bots' positions, including any enemy Bots' positions previously spotted which can no longer be spotted from the Mitcron's Bots' new positions.

"Spotting" occurs when one Bot, using its own sensory mechanism, detects the presence (and exact location) of an enemy Bot. Whether or not spotting can occur depends upon the rules for the individual level, which may include different rules for different types of Bots. For example, spotting may be permitted in a predetermined radius, normally 4 centimeters, regardless of the direction or barriers, such as hills and woods. This type of spotting is referred to as "range spotting". Another, referred to as "sight spotting" generally permits spotting any distance which is not blocked by barriers. Normally, range spotting s permitted by one type of Bots ("Range Bots" or "RBs") and sight spotting, by a second type of Bots ("Sight Bots" or "SBs"). These types of spotting are in no way intended to be limiting, and other types are intended to be included in the present invention.

Whether or not spotting occurs by either a Range Bot or a Sight Bot is determined by observing the type of terrain between the Bots (for a SB) and by measuring the distance between the Bots (for a RB). Spotting by Sight Bots is somewhat more complex than spotting by Range Bots. Thus, the following exemplary rules provide additional guidance for determining when a Sight Bot can spot another Bot:

1) An enemy Bot will always be spotted by a Sight Bot when:

a) Both Bots are within one centimeter of each other;
b) SB is in clear or on edge of woods and enemy is in clear with no obstructions between them;
c) SB is in clear and enemy is on hill;
d) SB is on hill and enemy is in clear;
e) Both SB and enemy are on hill; and
f) Enemy is on hill and SB is on the edge of woods facing the hill, regardless of any obstructions between SB and the hill.

2) Unless the two Bots are within one centimeter of each other, an enemy Bot will not be spotted by a Sight Bot when a) SB is in clear or on edge of woods and enemy is in clear but the line of sight is obstructed, e.g., with a hill or woods;
b) Enemy Bot is in woods or on edge of woods;
c) SB is in woods;
d) Enemy is on hill and SB is on edge of woods not facing the hill.

When determining whether a Bot is in a position to be spotted, the Mediator only needs to consider its final position. A Bot does not employ the ancient principle of continuous motion for movement. Rather, its relies solely on "teleportation", vanishing from its original position and instantly appearing in its final position. A Bot may move any distance up to the predetermined limit, commonly 3 centimeters, but does not have to move at all.

When a Bot spots an enemy's Bot or suspects an enemy's Bot to be located within blasting distance, the Bot, with the assistance of a second Bot on its team, can attempt to destroy the enemy's Bot by "Blasting". Blasting is the method of destroying Bots and is accomplished with high powered blasters capable of producing huge explosions at remote locations, with which each Bot is equipped. Generally, there are certain rules to be observed when blasting:

(1) Although only one Bot need be in a position to spot an enemy Bot, the enemy's Bot must be within a predetermined blasting range of a pair of Bots that are blasting, commonly 6 centimeters when a move may be up to 3 centimeters;

(2) Blasting destroys all Bots within a predetermined area of the target point, commonly one centimeter, including the blasting Mitcron's own Bots;

(3) Because everything within one centimeter is destroyed, blasting can be directed at any target point within one centimeter of the enemy Bot to destroy the enemy Bot; and (4) Blasting is an alternative to moving for any Bot any given turn, i.e., the pair of Bots used to blast cannot also be physically moved.

In one variation (or "level") of the game, discussed in more detail in the example called "Level Four" below, Blasting can be done using the Bots of an Ally (or Allies). Normally, an alliance is formed by entering into an alliance agreement with another Mitcron, signed by both Mitcrons. An example of an alliance agreement is as follows:

| ALLIANCE AGREEMENT |
|---|
| Let it be known this fifteenth day of September<br>in the year of our Lord<br>one thousand nine hundred eighty-nine...<br>the MUMMIES<br>and the PHOTONS<br>wish to be allies.<br>Signed: Mummies Mitcron<br>Signed: Leader of the Photons! - Red Team |

The agreement, after execution by both Mitcrons, is given to the Mediator, who then records the positions of the two allies' Bots and positions of enemy Bots spotted by both allies on both team leaders' maps. Optionally, the number of alliances into which a Mitcron can enter can be limited, for example, to one alliance at a time and, if desired, Blasting of a Mitcron's Ally can be prohibited. Alliances can be broken by mutual consent.

Alliance agreements are entered through Diplomatic Correspondence ("DC"), which is a second, optional, aspect of the game. Diplomatic Correspondence is communicated through the Mediator by including it with the Ordering of Bots. A piece of DC is normally a written message, but it may optionally be almost anything, so long as it is capable of being passed to the recipient by the Mediator.

DC must include the address of the recipient and can be sent anonymously and in handwriting designed to confuse or intimidate but may not be misleadingly signed by another Mitcron. DC, in addition to its use in forming alliances, can be used to give information, such as the location of other Mitcrons' Bots, in exchange for mercy, for example, to avoid being blasted. It can also be used to deceive other Mitcrons, etc. The uses of DC are limited only by the players' imaginations.

An example of DC (which might be sent when a Mitcron is down to one Bot and wants to trick the enemy into believing it is powerful so that the enemy will not blast the Mitcron's last Bot):

To: Green (Sea Idiots)
From: Red (Dark Knight)
I have noticed your careless positioning of your valuable Bots. Since I deftly have eluded your defenses, I maintain a constant spot on each of your Bots. I have no quarrel with you, but I don't respect your strategies. If -continued you don't agree not to attack my forces, you will be immediately destroyed.
Dark Knight

LEVELS OF MITCRON

A game of Mitcron can comprise a number of levels. Every level is a different scenario of the game with a different map, a different objective, and a different story from every other level. Although levels are by themselves "mini-games" separate from other levels, they are related to one another in a single game by the "bonus system", which awards bonus points cumulatively from level to level. Levels may be numbered sequentially to denote how many levels a group of Mitcrons has played together; that is, the first level played by a group of Mitcrons would be Level 1. "Moving up a level" really doesn't mean that a Mitcron is rising to a new level of experience—it just means that a new scenario, i.e. level, is being played with the same players.

Different groups of players may compete through different series of levels simultaneously. In such a case, games may be numbered to distinguish between different groups of Mitcrons a Mediator might be mediating at the same time. For instance, Mediator A may have three games, one currently playing Level 2, one playing Level 3, and one just beginning on Level 1. Games usually keep the same Mitcrons playing together, for the purpose of allowing players of approximately the same amount of playing experience to compete with one another. Games in some levels may be merged to form new games, as might occur when Level 4, later described, is played because Level 4 generally requires more players.

The variety of levels of the game are limited only by imagination, so long as the basic characteristics of the game described above are retained.

BRIEF DESCRIPTION OF THE DRAWINGS

FIGS. 1 through 4*b* illustrate maps which can be used to play different levels of the game of Mitcron. Maps are transparent sheets, normally 8½" by 11" for convenience, which have been reduced to 64% their normal size in the drawings. The circular figures represent hills and the irregular shapes, woods. Unmarked areas represent "clear".

FIG. 1 is further described in Level One; FIG. 2, in Level Two; FIGS. 4*a* and 4*b* in Level Four.

The detailed description of the game in the following description of the four levels, which may be played in any desired order, illustrates the multifaceted character of the game but is in no way intended to be limiting:

LEVEL ONE

Figure 1:
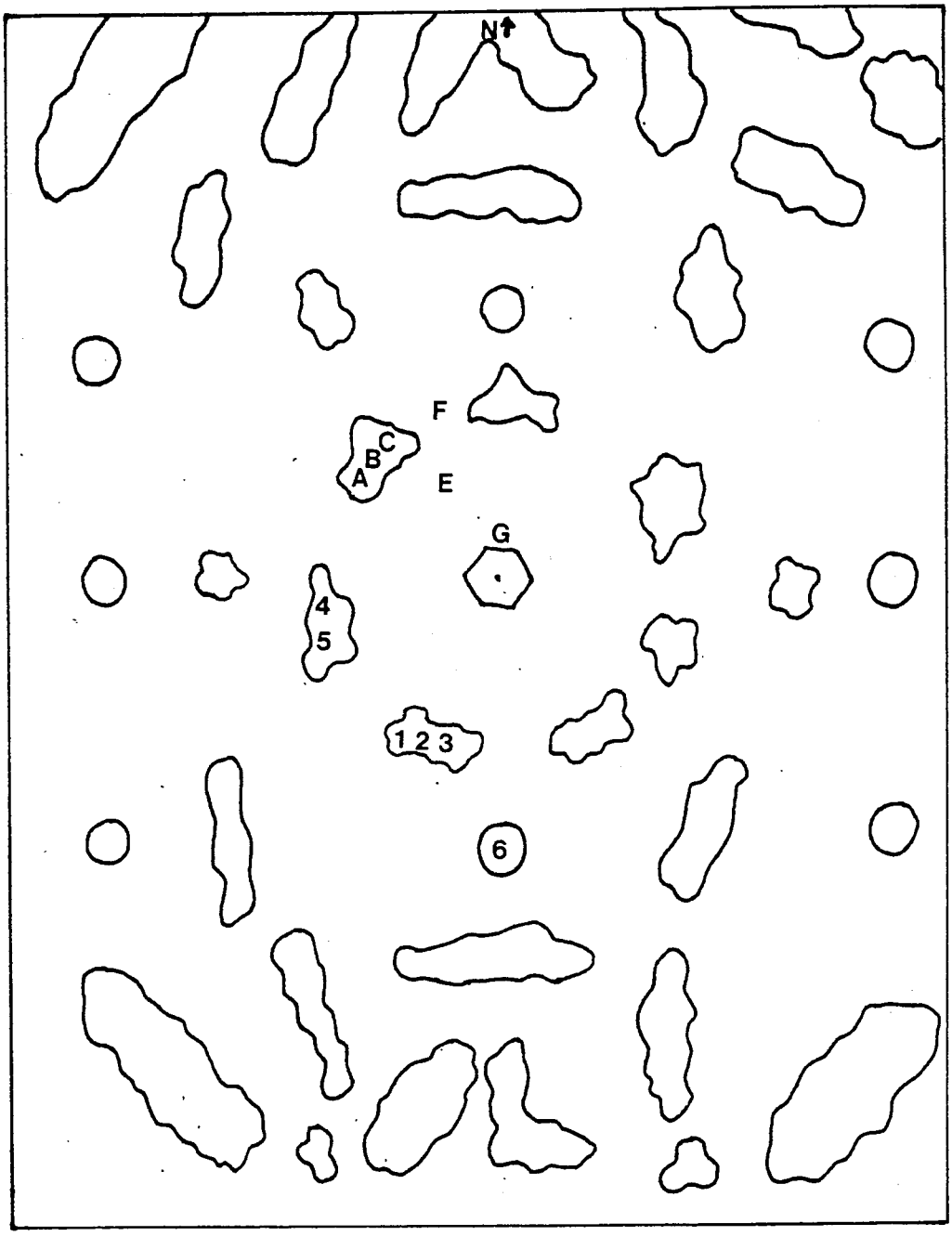

In this level there are two Mitcrons and a Mediator. The first Mitcron ("Red") is the leader of a first team of four Red Bots, referred to as the red team, and the second Mitcron ("Blue") is the leader of a second team of four Blue Bots, referred to as the blue team. Each of the Mitcrons and the Mediator has a transparent battlefield map used for marking positions and Ordering of the Bots. FIG. 1 represents the Mediator's map. In FIG. 1, the Red Bots' initial positions on the map are indicated with the numbers 1, 2 and 3; and the Blue Bots' initial positions on the map are indicated with the letters A, B and C. For simplicity of description (to illustrate interaction of the two teams' Bots), the initial positions of the Bots are assigned near the hexagon in the middle of the map, called the central objective. In reality, the initial positions for this level would be assigned close to the edge of the map and equidistant from the objective.

The object of this level or scenario is to move as many Bots as possible into the central objective, i.e., the hexagon. At the end of the level, each Mitcron is awarded or penalized bonus points (which can be used to buy more Bots in subsequent levels) according to the number of its Bots which it orders into the hexagon in relation to his enemy. Each Mitcron tries to destroy his enemy's Bots in addition to moving its Bots into the central objective to indirectly boost its own power.

Level 1 begins with the Mediator deciding where to locate the Bots of each team on the map. The Mediator decides to locate them as indicated in FIG. 1, i.e., in the woods occupied by 1, 2 and 3 and by A, B and C. These positions are recorded on the master map. The Mediator then superimposes Red's map over the master map and records Red's Bots' positions (1, 2 and 3) on Red's map, and then superimposes Blue's map over the master map and records Blue's Bots' positions (A, B and C) on Blue's map. The Mediator then gives Red and Blue their maps and awaits the first order.

Red looks at its map with three symbols denoting the Red Bots' positions 1, 2 and 3. The positions of Blue Bots, under the direction of Blue, are not on Red's map at this point. Blue, on the other hand, is looking at its map with three symbols denoting the Blue Bots' positions, and the Red Bots are nowhere to be seen. The Mediator has a map that shows the exact positions of all six Bots. The game has begun, and the Mediator awaits the first Ordering and, optionally, DC to be submitted to the Mediator for processing.

Red looks at its map. The Red Bots are in positions 1, 2, and 3. The Red Bots in positions 1 and 2 are Range Bots, or RBs, and the Red Bot in position 3 is a Sight Bot, or SB. (The different types of Bots would be indicated on Red's and the Mediator's maps with different symbols such as those in Table 1.) Noting that a Blue Bot has not been spotted yet, Red realizes that there must not be any Blue Bots within four centimeters of his two Range Bots, and that there must not be any Blue Bots in the open in any straight line of sight from his SB's position. Feeling that its Bots' positions are safe enough, Red decides to move its RBs forward towards the objective. For better spotting ability, Red moves its SB to the top of a hill.

Having decided on a plan of action, Red records his order onto its map. To indicate the Red Bots' movement, Red draws lines from the Red Bots at positions 1, 2 and 3 to positions 4, 5 and 6, respectively. At the end of each line, Red redraws the Bot's symbol. Finally, Red confirms that each line is under three centimeters (the limit of movement for Bots in this level). Now that the strategic half of this move is complete, Red completes the diplomatic portion of his turn, i.e., the sending of Diplomatic Correspondence to his enemy. On a sheet of paper Red writes "To Blue: DIE SUCKER!! Love, Red." Red's turn is at this time ready to be processed by the Mediator.

Placing its map and DC in an optional folder, Red gives its folder to the Mediator. The Mediator then reviews Red's move to be sure it's understood; opens both the Mediator's folder and Red's folder and removes the master map and Red's map and lays them on the table, out of sight of Red and Blue. The Mediator is ready to process Red's move. First, the Mediator uses a measuring device to make sure that Red's three moves are legal, i.e., that each under three centimeters. Satisfied that they are legal, the Mediator superimposes the master map over Red's map, erases the positions of Red's three Bots at positions 1, 2, and 3 from the master map, and then records Red's Bots' new positions on the master map at positions 4, 5, and 6. Next the Mediator superimposes Red's map over the master map, erases Red's three Bots at positions 1, 2, and 3 and the lines that connected the old positions and the new positions. The Mediator does not erase Red's Bots from positions 4, 5, and 6, because these are their current positions.

The next phase in processing Red's move is to check for any spots of enemies. The Mediator, using the spotting rules described above, determines the following: the SB on the hill at position 6 does not spot any Blue Bots; the RB at position 5 is not within the 4 centimeter spotting range of any Blue Bot; the RB at position 4 is within spotting range of the Blue Bot at position A. Using a blue marker, the Mediator then records the position of the Blue Bot at position A on Red's map.

Next the Mediator is ready to process DC. The Mediator removes Red's DC from Red's folder and places it in the master folder and checks for any DC in the master folder addressed to Red. (Of course, since this is the first turn, there is none, so no DC is delivered to Red.) Finally, the Mediator places Red's map and the master map in their proper folders and then gives Red's folder back to Red.

The Mediator then waits for the next order to process, which can be submitted by either Red or Blue.

It happens that Blue is already planning his move. Blue has Bots in positions A, B, and C. The Blue Bot in position C is an SB, and the Blue Bots in positions A and B are RBs. The types of Bots are indicated on Blue's and on the Mediator's maps by using symbols such as those in Table 1. The only markings on Blue's map are those of its own Bots in blue. Blue does not realize that his Bot at position A has been spotted by Red's Bot at position 4. Using the method of measuring, straight lines, and redrawing symbols described above, Blue moves his Bots that were at A, B, and C to positions D, E, and F, respectively. Blue opts not to send any DC, and quickly turns in its folder to the Mediator.

The Mediator then processes Blue's order. First, on the master map, the Mediator erases Blue's Bots' old positions at A, B and C and records Blue's Bots' new positions at D, E and F as previously described. Then the Mediator erases everything on Blue's map except the new positions of the Blue Bots and measures to see if any of Blue's RBs spot Red Bots. The RB at position D spots two of Red's Bots at positions 4 and 5, so the Mediator records the Red Bots' positions at 4 and 5 on Blue's map using a red marker to identify the enemy Bot's team. The SB at position F is in the clear so is able to spot the Red Bot on the hill at position 6. Using a red marker, the Mediator records Red's Bot at 6 on Blue's map. The Blue RB at position E, even though it wouldn't have any effect on Blue's map if it did spot anything since all three Red Bots have been spotted, does not spot any Red Bots.

The Mediator then processes Blue's DC. There is no DC in Blue's folder going out, but there is DC in the master folder addressed to Blue, so the Mediator places the DC addressed to Blue in Blue's folder. The Mediator then returns Blue's folder to Blue, and waits for the next order.

Red and Blue both study their maps. Each player realizes that the next move could be the one that turns the momentum of the game to his favor, so each player races to beat the other one in turning in a well-thought out move. Unfortunately for Red, Blue acts first.

Blue, with Bot positions D, E, and F, and spotted enemy positions at 4, 5, and 6, is ready to take control of the gate by blasting two of Red's Bots at positions 4 and 5. First Blue puts a solitary dot on its map between positions 4 and 5 to denote the target point of its blast. (If the blast is successful, the one centimeter blast radius of the blast will envelope both of Red's Bots.) Then Blue measures from the target point to the Blue Bots that will blast at positions D and E to confirm they are within the six centimeter blasting range. Satisfied that the blast is legal, Blue completes its blast order by drawing a dotted line from the Blue Bot at D to the point, and from the Blue Bot at E to the point. Since the Blue Bots at D and E are blasting, they are not allowed to move during this turn—the only Blue Bot able to move is the SB at F.

Blue tries to decide whether or not to move the SB at F at all, since it seems to be in a fairly safe position. Blue decides, though, to move the SB toward the central objective and thus orders the SB at F to move to position G.

Feeling confident enough that there is time to turn in this order before Red turns in another order, Blue writes a piece of DC to Red: "To Red: You'll die first-!—Blue." Blue then places the DC in its folder and submits it to the Mediator, along with its map.

The Mediator then processes Blue's order. After determining the legality of Blue's orders, the Mediator superimposes the master map over Blue's map. The blast ordered from Bots at positions D and E was successful, so the Mediator erases Red's Bots at positions 4 and 5 from the master map. The Mediator then updates Blue's SB position to G and erases its old position at F on the master map.

The Mediator then superimposes Blue's map over the master map. The Mediator erases the target point and the dotted lines used for the blast from Blue's map. Updating Blue's spotting, the Mediator erases the positions from Blue's map of Red's Bots at positions 4 and 5. (Blue doesn't spot them any more because they have been destroyed.) Finally, the Mediator keeps the position of Red's Bot at position 6, since Blue's Bot at position G can still spot to the hill.

The Mediator processes Blue's DC by putting Blue's DC to Red in the master folder and returns Blue's folder.

This would not, of course, be the end of the scenario in an actual level. The above description is only of a small part of a very simplified game. It is sufficient, however, to illustrate how the basic game is played. The process remains the same for complex games involving six players or more.

Levels Two, Three and Four, hereafter described, are played in a manner similar to that described for Level One but are modified as indicated.

LEVEL TWO

"Attacking a Castle"

Figure 2:
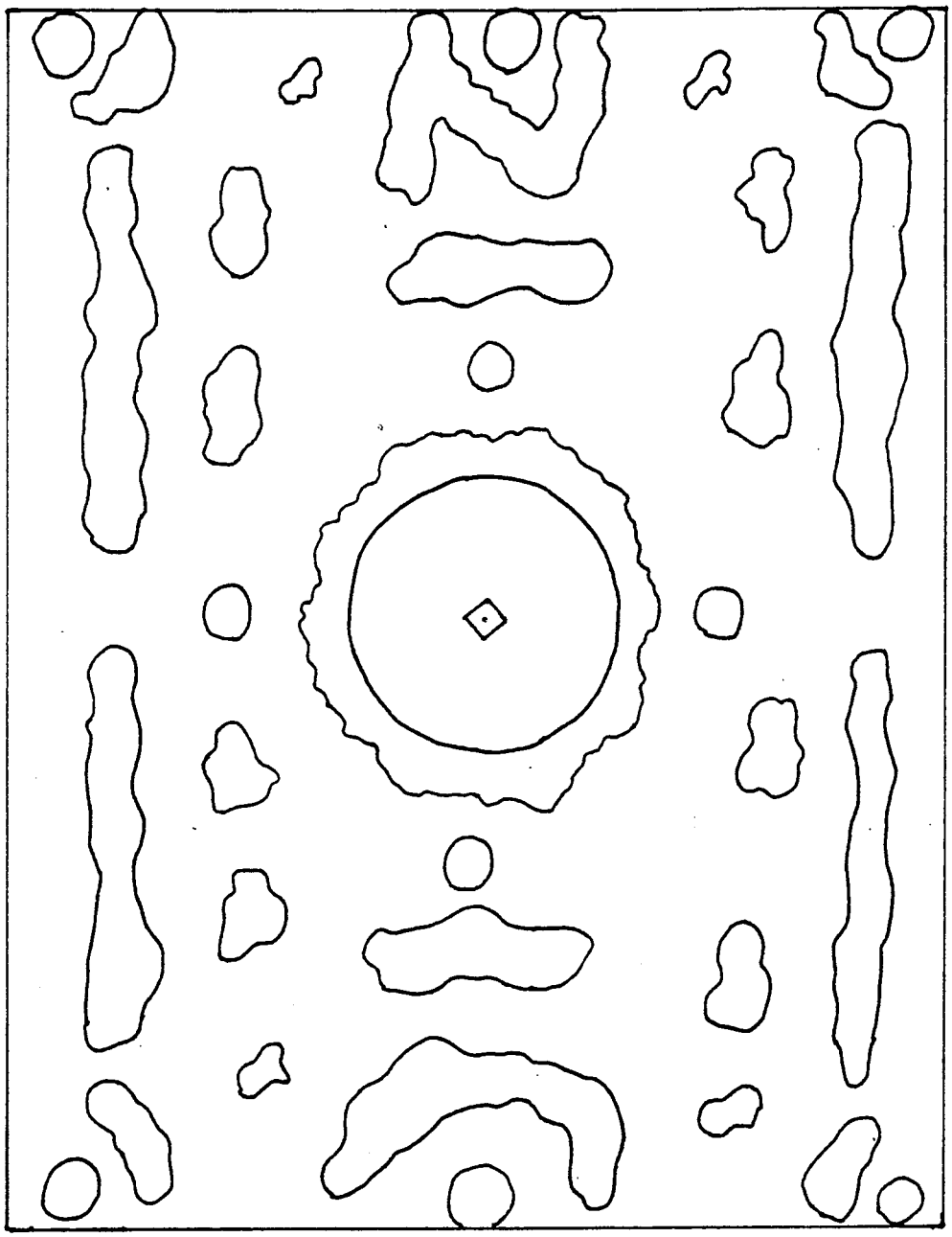

All of the basic rules illustrated in Level 1 are used in Level 2. There are a small number of rules that supplement the basic rules for the play of Level 2, and those will be discussed later. The level may be played by two or more players, or Mitcrons, but for the sake of clarity, Level 2 will be described as it would be played by five Mitcrons on a map such as that reproduced in FIG. 2.

The story behind Level 2 is that there is a castle in the middle of the map that four of the Mitcrons must enter to receive a bonus. These four Mitcrons are the "Attackers" in this scenario and are told that they must enter the castle, and the fifth Mitcron (usually the player with the most points) is assigned the position of "Defender" of the castle. The Defender receives a bonus for preventing the Attackers from entering the castle.

With four Attackers against one Defender, the battle would seem to be weighted in favor of the Attackers. However, because of a number of factors, the odds are quite even. The four Attackers are not told that there is a player defending the castle (only the Mediator knows this); they are, however, told that there is a puzzle in Level 2 that must be solved for success. The Defender, on the other hand, is allowed to deploy his forces anywhere on the board (within a specified radius of the castle). The Attackers, then, have the power to defeat the Defender if they join forces.

Two factors make a victory for the Attackers difficult. First, a joining of forces might not come to pass in that one Attacker may want to destroy the other Attackers and enter the castle alone, thereby gaining a larger bonus at the end of the level. The second more likely factor is that the Attackers, not having been told about the Defender, may never discover that the Defender even exists.

To win, the Attackers must first realize that there is a Defender, and then agree to cooperate with each other to defeat the Defender. One way the Attackers could realize the threat of a defense is by looking at their initial placement on the map. Each of the four Attackers is put in one of the four corners of the map. An Attacker, noting his corner position and hypothesizing that three of the other four Mitcrons would be in the three remaining corners, might logically wonder where the fifth Mitcron would be deployed. This type of thinking could lead to the conclusion that a different type of Mitcron might exist.

The Defender possesses many tools to prevent a successful invasion of the castle. He must, however, use the tools wisely; the odds are four to one in the Attackers' favor. First and foremost, the Defender must use good strategic skills to stay alive, destroy Attackers, and keep an ongoing watch of the hill surrounding the castle. The more powerful, more subtle approach to success, however, is a tricky use of DC. If notes are written carefully enough, the Defender could cause enough confusion (by dispelling any rumors of a Defender) to weaken the four Attackers. A need for good strategic and diplomatic actions makes the Defender's role challenging but enjoyable.

Certain rules regarding diplomacy are made for Level 2. To make complete cooperation between the four Attackers possible, each of the Attackers is allowed to form alliances with as many of the other players as possible (except the Defender, but the Attackers are not told this). Also, to make diplomatic chaos possible for the Defender, the Defender is allowed to sign DC under a false team name (such as that of another player).

LEVEL THREE

"The Magnetic Attraction"

Scenario

Figure 3A:
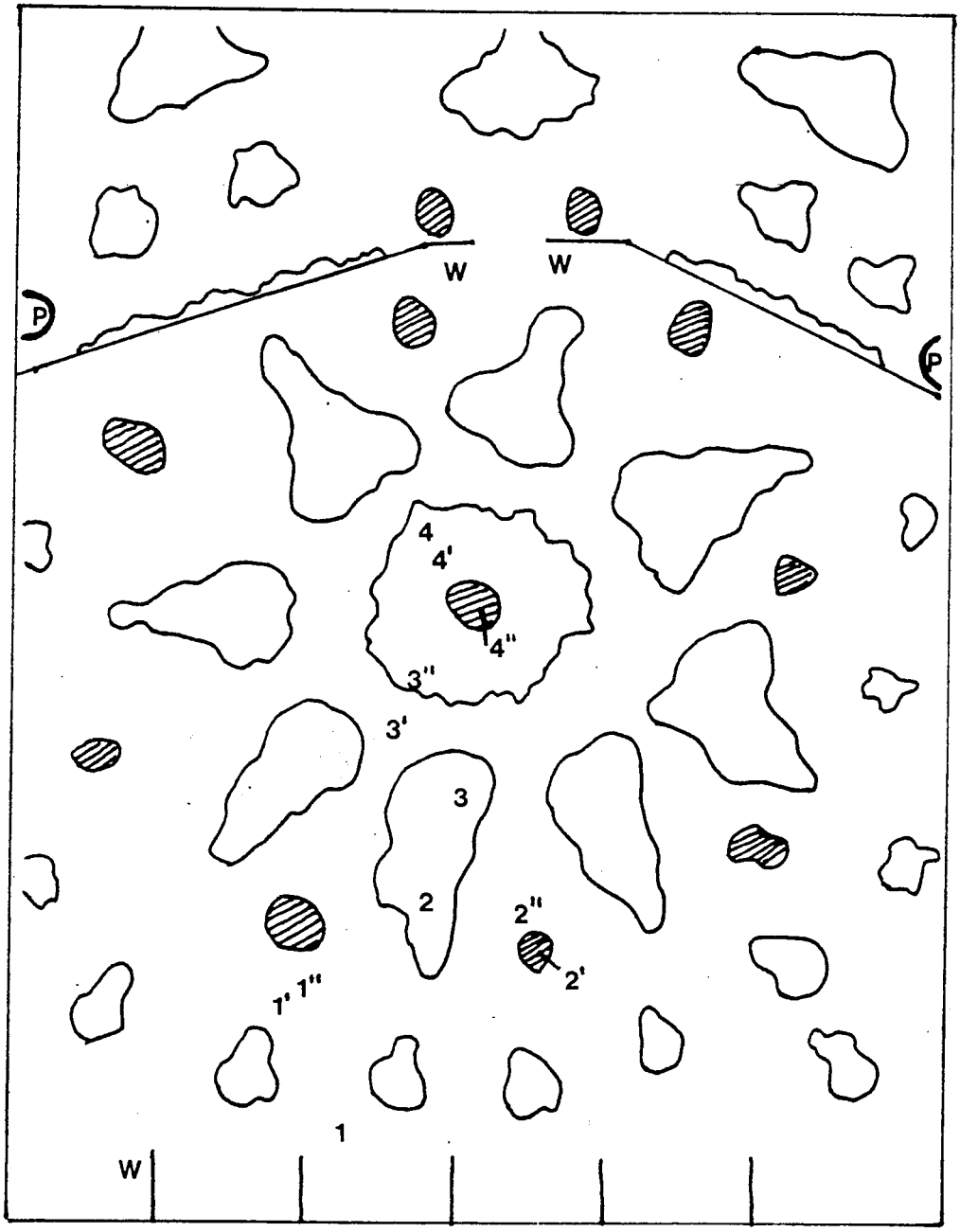
FIGS. 3*a* and 3*b* in Level Three.
Figure 3B:
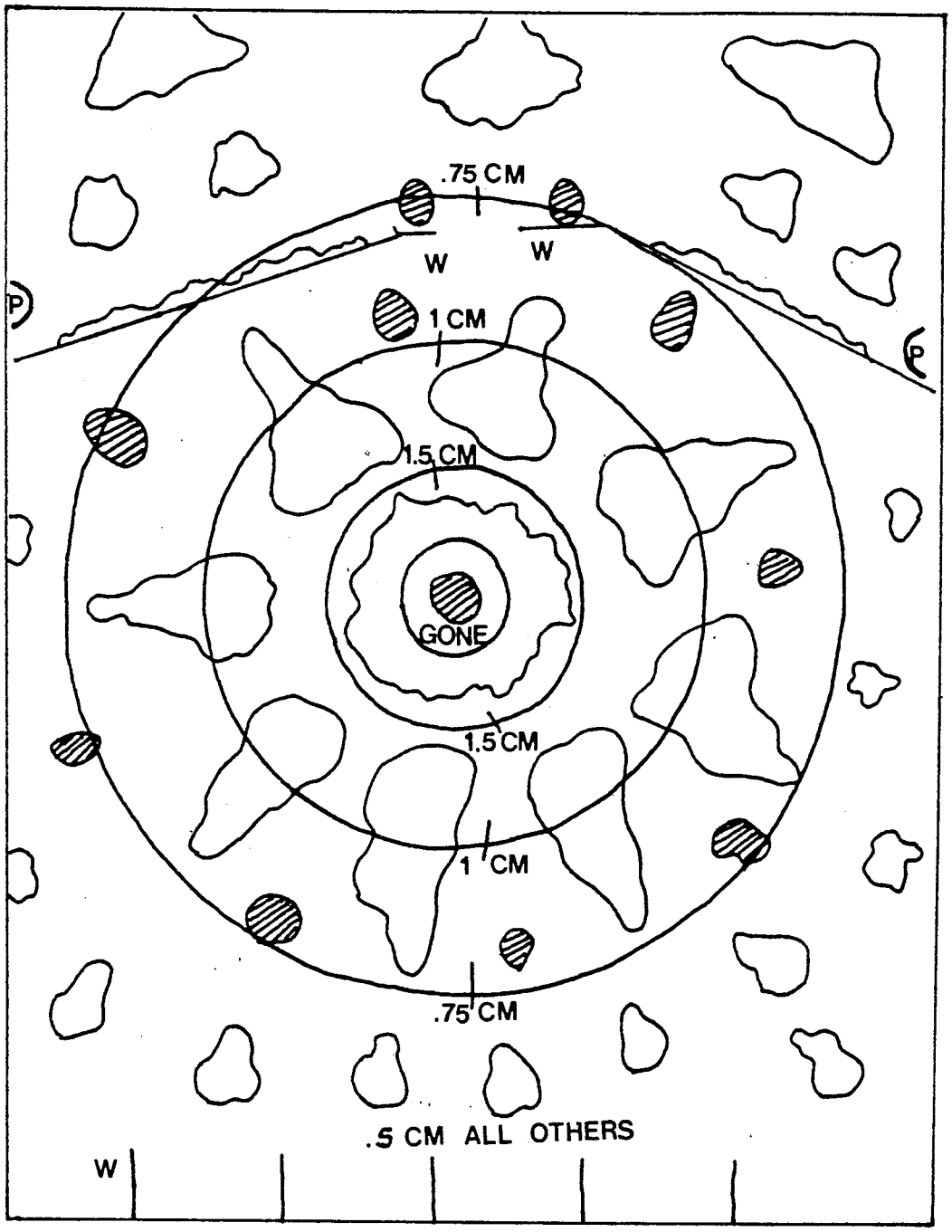

The third level of the game is played on a map such as that illustrated in FIGS. 3*a* and 3*b* and incorporates a new concept that alters the rules of movement for Bots: magnetic attraction. At the center of the battlefield for Level 3 lies a huge, invisible magnet that draws Bots toward the center of the map each time they move. As the position of the Bots come closer to the magnet, the attraction becomes greater. In fact, if a Bot comes too close to the magnet, it will be sucked into the center permanently and destroyed. Mitcrons, in this level, must move their Bots to exit the battlefield through the two escape pods, labeled "P" in FIG. 3*a*, located on the east and west edges of the northern half of the map. Bonus points for each Mitcron are determined by the number of Bots making a successful exit.

Description

The real challenge of Level 3 is not avoiding the pull of the magnet but actually discovering the existence of the magnet. Mitcrons are not told that there is a magnet in the level; they are told, however, that there is a "puzzle" in the level to be solved. A Mediator may optionally give hints to the Mitcrons, for example, by describing something unusual (such as a statue) on the hill in the center of the map. An especially creative Mediator may want to write the Mitcrons a brief story laced with hints that sets the stage for Level 3 and its puzzle. These methods of giving hints, if they are employed by the Mediator, arouse the Mitcrons' interest in the mysterious qualities of the center of the map, and, ultimately, the puzzle in Level 3. The game is then more enjoyable.

Some of the hints to the solution of the puzzle are not dependent upon the Mediator but lie on the map itself. The shapes of hills and trees are deformed from their usual shapes to suggest a gradual movement toward the center, as shown in FIGS. 3*a* and 3*b*. The only regularly shaped terrain is the hill and clump of trees which has reached its equilibrium in the very middle of the map.

The biggest hint to the Mitcrons will be the actual effect the magnet has on their own Bots. Each time a Bot moves, regardless of its position, it will be drawn in a direction exactly toward the center of the map. To determine the magnitude of the effects, the Mediator uses a copy of the map with a scale of radii written upon it as shown in FIG. 3*b* (which does not appear on the players' maps). In FIG. 3*b*, there are marked off five different areas of the map, each associated with a different amount of magnetic attraction, lessening as the distance from the center increases, for example a Bot is pulled toward the center 1.5 centimeters when its intended final position is in the second radius from the center and only 0.5 centimeters when its intended final position is in the outermost radius. ("Gone" indicates that any Bot intended to be in this radius is immediately pulled into the center and destroyed.) The Mediator knows how far to draw in the moving Bot (always from its intended final position) by noting in which of the marked off areas the Bot's final position would be in the absence of any magnetic force.

Examples of Bots being drawn to the center are illustrated in FIG. 3*a*. A Bot at position 1 moving to position 1' would be drawn (according to the scale in FIG. 3*a*) in a straight line towards the center 0.5 cm, and the final position of the Bot would be 1''. A Bot whose intended final position was 2' would, since the intended final position of 2' lies in the 0.75 cm attraction area, would become the actual final position of 2' 0.75 cm away. A Bot moving from 3 to 3' (in the 1.0 cm area) would be drawn to 3''. The fact that the actual final position of the Bot lies within an area of different attraction (for example, 1.5 cm) does not affect the original attraction of 1.0 cm. A Bot moving from 4 to 4' would be drawn in all the way to the middle of the map and stuck there permanently. Again the amount of attraction is determined by the intended final position of the Bot (which lies in the first radius of the scale) and not the original position of the Bot (which lies in the second, 1.5 cm attraction, radius).

The examples in FIG. 3*a* were written using the scale in FIG. 3*b*. The scale or parts of the scale (such as the division of areas and the corresponding attraction distances) are only meant as examples for a scale that might be used for Level 3. The scale may be modified by the Mediator for personal satisfaction when playing Level 3.

Further the Magnetic Attraction level is only one example of a "Puzzle Level". Others based on the same general concept can be used.

Special Rules

When the Mediator processes a Mitcron's turn in Level 3, the Mediator modifies the processing steps previously described. In addition to checking the legality of Mitcrons' orders and status of Bots, the Mediator uses the scale to record the actual final positions of all moved Bots on the Mitcrons' maps, as modified by the attractive force. Then, when the master map is superimposed over the Mitcrons' maps during processing, the Mediator does not write the intended final position of the Bot on the master map but, rather, records the modified final position of the Bot. Finally, when erasing old positions of Bots and movement lines from a Mitcron's map, the Mediator additionally erases the Bot's intended final position but does not erase the Bot's actual final position.

Walls are added to the terrain on the maps in Level 3; these walls are then carried over to following levels. The will, denoted by unbroken lines (shown in the northern half and the very Bottom of the map illustrated in FIG. 3*a* and 3*b* and labeled "W"), restricts the ordering of Bots: No Bot may be ordered to move or blast through a wall, and no spotting can occur through a wall. The only way a Bot may move through a wall, other than through an opening in the wall, is by moving close enough to the wall so that it is drawn through the wall magnetically.

Each team begins at the bottom of the map, separated from the other teams by the short walls at the bottom of the map. The walls are added to Level 3 to ensure that all Bots, starting in different positions at the bottom of the map at the beginning of the level, have an almost equal chance of escaping through the pods at the top; every Bot must pass through the same gap in the wall in the north of the map. Bots who seem to have the advantage of a shorter distance to the gap in the upper wall because they start in the middle of the bottom of the map will see the advantage nullified by the added danger of starting the level closer to the magnet in the center of the map.

LEVEL FOUR

"Capture The Flag"

Level 4 is best played by three or more players. In this example, to more completely describe this level, nine players are used. Level 4 is played on a map such as that reproduced in FIGS. 4*a* and 4*b* (one-half of the map in each).

Description

The main concept of Level 4 is similar to that of the outdoor game "Capture the Flag." In Capture the Flag, team A may win by stealing a specified marker (in this case, a flag) from team B's base and returning it to team A's base. For a team to win, then, it must concentrate both on the defense of its own base and the attack of the enemy bases.

Level 4's nine players are divided into three alliances, or three "teams". Each alliance is made by the Mediator at the beginning of Level 4. If appropriate, alliances are determined according to the point totals of each of the nine players accumulated from earlier-played levels. In forming the alliances, the Mediator makes sure that each of the three alliances has a combined bonus point total (of the totals of each of the three players in the alliance) that is as equal as possible to the combined point totals of the other two alliances. This way power is distributed fairly, and each alliance, judging by the number of Bots it can purchase with its bonus points from previous levels, has an equal chance for victory in Level 4. No alliances other than the ones made at the beginning of Level 4 are allowed to be made.

Normally DC is not communicated verbally, but, in Level 4, the Mediator may attempt to promote cooperation within the alliances by allowing face-to-face communication between the different players within an alliance. The Mediator may not want to confuse the players by modifying another rule, but there are advantages in using the rule. Those advantages are outlined in the discussion of the play of Level 4.

Each of the three alliances is assigned a "base" on the map to defend. Each base contains a marker (denoted by a "+" sign in FIGS. 4*a* and 4*b*) that is analogous to the flag in "Capture the Flag". To win, an alliance must collect all three of the markers inside its own base.

At the beginning of the level, the Bots on each team are located anywhere in the four clumps of trees immediately surrounding that team's base. At the end of Level 4, bonus points are awarded on the basis of individual and team performance. A set number of bonus points is awarded to each member of the winning alliance for collecting the three markers. Bonus points are also awarded to each of the nine players according to the ratio:

$$\frac{\text{(point value of Bots still "alive" on the battlefield)}}{\text{(point value of Bots alive at beginning of Level 4)}}$$

The bonus awarded to the winning team should outweigh any bonus to individual players for surviving Bots.

There are certain rules in Level 4 pertaining to bases. Each base on the map is denoted by a small square in FIGS. 4*a* and 4*b*. The area enclosed by the four sides of the base is the "inside" of the base, and the area outside of the square is the "outside" of the base. Bots may move in and out of their own base as much as they like, but they may not leave their base with a marker. (An enemy Bot inside another team's base would not be spotted by either the RBs or SBs guarding the base outside.) No blasting is allowed inside bases.

There are several rules that deal with the markers. Any marker in a base appears on the maps of the players who belong to the base. (For example, if a player's team's base contains two markers, two "+" signs will be written on that player's map inside the square denoting the base by the Mediator. If the player's team's base contains no markers, no "+" signs will be present inside the base.) Players cannot determine whether or not an enemy base contains any markers without moving a Bot into the enemy base.

To "steal" a marker from an enemy base, a Bot must move into the enemy base that contains a marker (or markers) and then move outside of the base. Once a player's Bot is inside a base, the Bot will automatically spot any markers in the base. Once a Bot leaves a base containing markers, the Bot is considered to have possession of any markers that were inside the base. As long as the Bot has a marker, a "+" superscript will be added to its symbol. A Bot can carry up to two markers (and thus may have two "+" superscripts). If a Bot is destroyed while carrying a marker or markers, each marker carried will automatically be placed in the base last passed through by the carrying Bot.

Figure 4A:
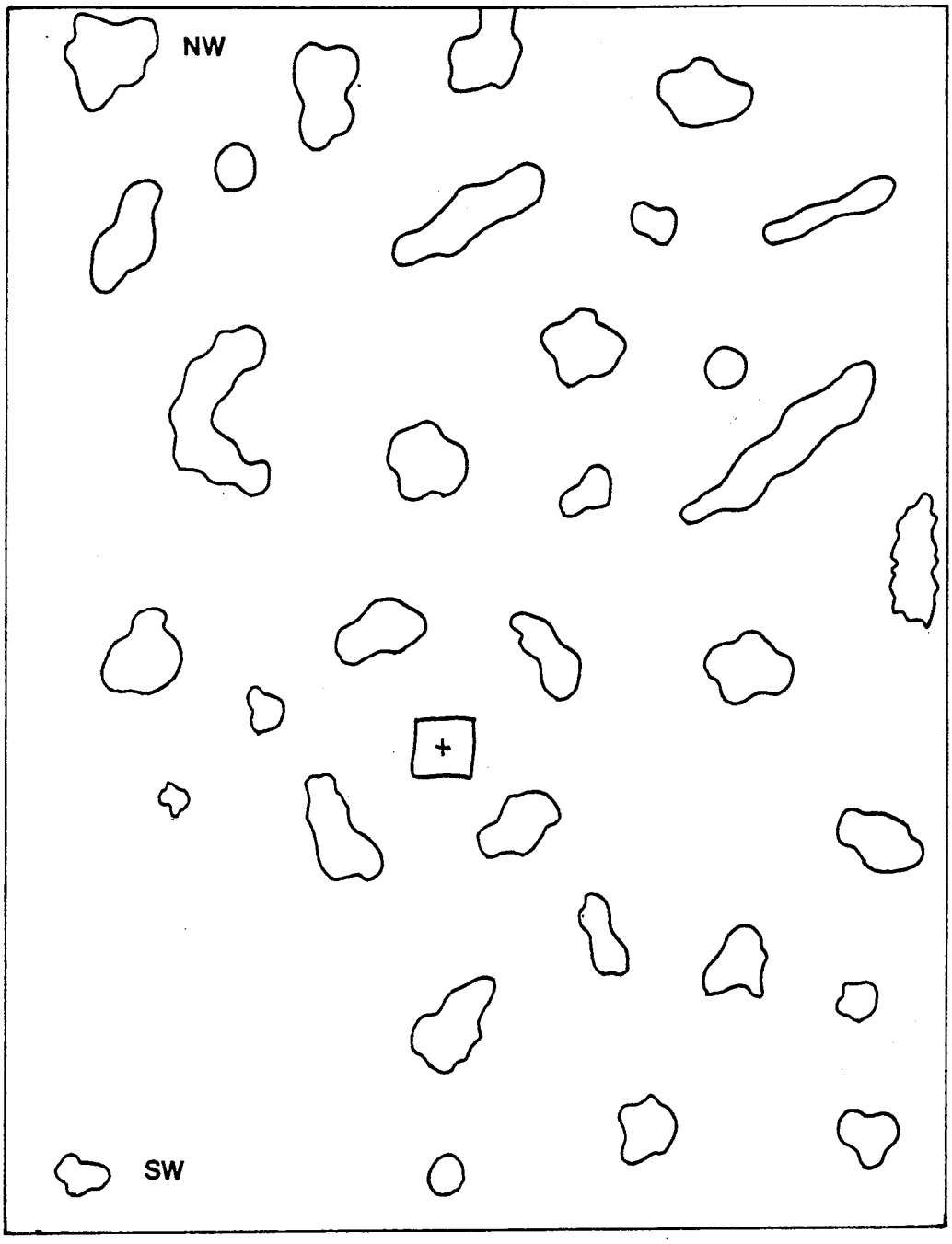
Figure 4B:
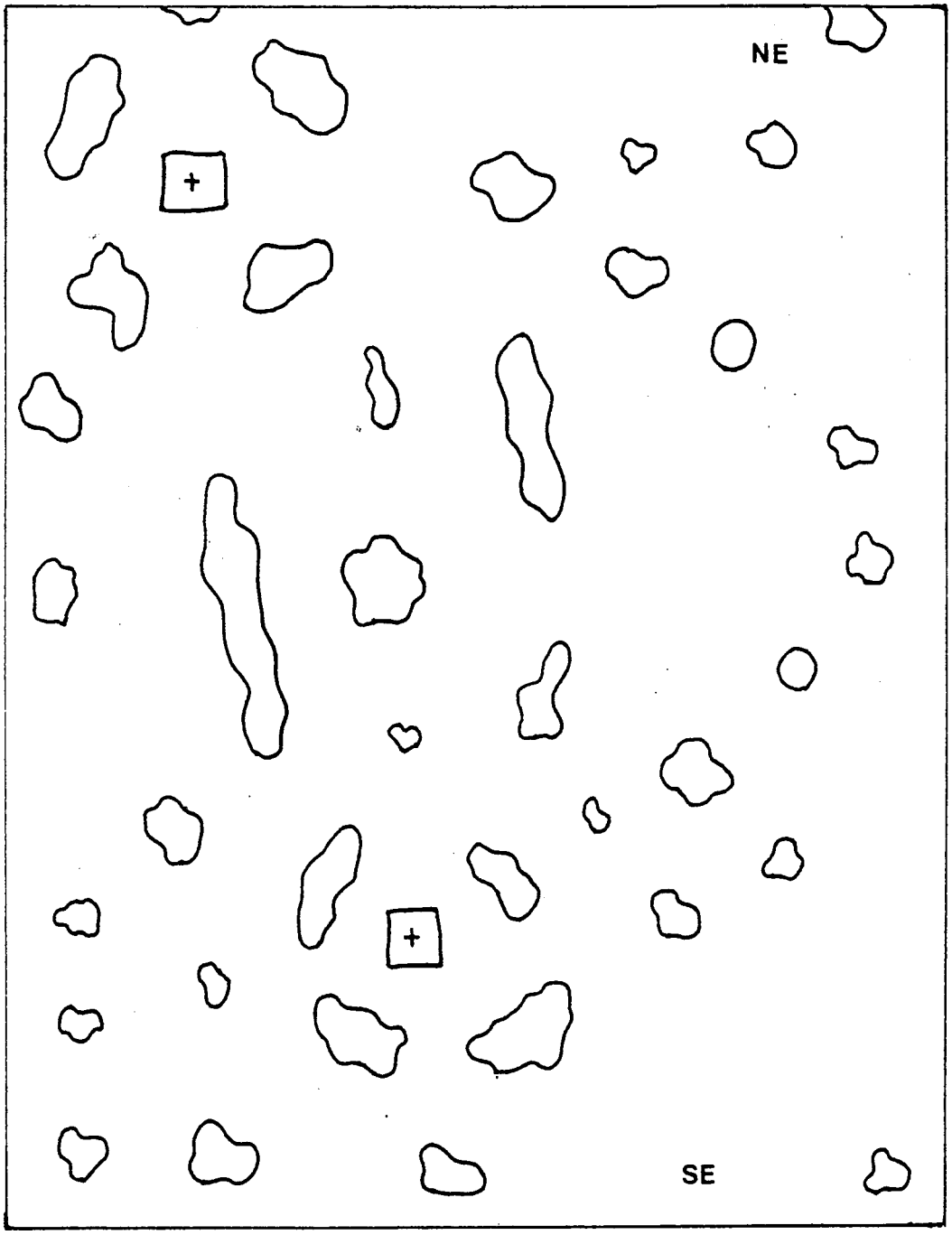

Since there are three bases on the map that must be spaced some distance apart for meaningful play, the map in Level 4 is normally twice the size of the map in the other three levels. For convenience in producing the double-size effect, two normal sized transparent sheets may be used and aligned beside each other. There are, then, two half-maps that are used for play in Level 4. One is designated the west map, and one is designated the east map. The players and Mediator differentiate the two by referring to the letters, "NE," "NW," "SE," and "SW" permanently affixed in the four corners of the map referring to four major points of a compass. Half-maps are aligned to form the entire map by touching together (but not overlapping) the east edge of the west map and the west edge of the east map. An example of two halves are shown in FIGS. 4*a* and 4*b*.

The border down the middle of the map has no bearing whatsoever on any rules of play. Bots may move, spot, and blast across the middle of the map as though the half-maps were actually joined.

The Play

Planning a strategy for an alliance in Level 4 is complex. An alliance should focus primarily on teamwork and cooperation between all three players. Bonus points, after all, are given (partly) according to alliance performance; the players in an alliance, therefore, must be able to plan and execute plans together. That is why the optional rule allowing face-to-face communication may be put into effect by the Mediator. Communication between alliance members is crucial in Level 4.

There are more requirements for alliance success than communication, however. An alliance must plan and execute a successful attack on both of the two enemy bases while, at the same time, defending its own base from enemy attacks. Alliances survive by preserving the delicate balance between defense and attack. Therein lie the complexities of planning strategies in Level 4.

ADDITIONAL LEVELS

One way to create additional levels is to add new types of Bots, other than SBs and RBs. For example, in Level 2, two new types of Bots may be added to the game. The rules pertaining to these Bots carry over to any other successive level in which these Bots later appear. The first of the two new types is the "Monobot," a Bot which does not require a second partner Bot to execute a blast. A player could order a blast, then, by drawing a dotted line from a Monobot to a target point without having to draw a dotted line to the target point from a second bot. Movement rules are the same for Monobots as for normal SBs and RBs. To distinguish between the two main types of bots (sight spotting and range spotting), Range Monobots and Sight Monobots are created.

The second of the new types is the "Invisibot," a Bot that cannot be spotted by any enemy Bot. The weakness of the Invisibot (to offset the advantage of "invisibility") is that, if it comes within a certain range of an enemy Bot, the Invisibot is destroyed. (The Invisibot may also be destroyed by normal enemy blasts, although the Invisibot will not be spotted by the enemy.) To differentiate between the two spotting types, Range Invisibots and Sight Invisibots are created.

Other new types of Bots similar to these may be used in later levels. Possibilities of new types are: Bots that are "invisible" to only one type of spotting (i.e. a Bot that could not be spotted by range spotting, or a Bot that could not be spotted by sight spotting), Bots that combine the Monobot and Invisibot characteristics, Bots that have extended blasting ranges, Bots that create blasts with extended blast radii, etc. The possibilities for new types of Bots are endless, but they all stem from the same basic rules.

Examples of different types of Bots which may be used to vary the playing of the game are listed in Table 1. All Bots are assigned a predetermined point value to be referred to during the purchase of Bots by players at the beginning of every level.

TABLE 1

| Short Name | Full Name | Symbol | Suggested Point Value | Specialty |
|---|---|---|---|---|
| RB | Range bot | × | 1 | |
| SB | Sight bot | ⋈ | 1 | |
| RMB | Range Monobot | ⊕ | 1.5 | May blast without |
| SMB | Sight Monobot | ⊕ | 1.5 | a partner |
| RIB | Range Invisibot | ∠ | 3 | Invisible to all spotting |
| SIB | Sight Invisibot | ⊿ | 3 | Destroyed if within 1 cm of enemy |
| | RIRB Range-Invisible Range Bot | | | Invisible to Range |
| | RISB Range-Invisible Sight Bot | | | Spotting |
| | SIRB Sight-Invisible Range Bot | | | Invisible to Sight |
| | SISB Sight-Invisible Sight Bot | | | Spotting |

THE BONUS SYSTEM

The ultimate object of the game is to accumulate as much power (over enemy Mitcrons) as possible. This is most easily achieved by obtaining as many tools for destruction, i.e. Bots, as possible. In the game, however, there are different types of Bots with different amounts of value; therefore, just as in the real world, there exists in the game a standard currency with which all weapons may be purchased. The basic quantity of currency in the game is the "bonus point." The giving of bonus points to, or the taking away of bonus points from, a Mitcron is called a "bonus."

Bonuses are given to each Mitcron at the end of each level according to the Mitcron's degree of success in achieving the goals established at the beginning of the level. (For example, in Level 1, the Bonus a Mitcron receives is entirely dependent upon the number of Bots that are successfully moved into the central objective.) Once again, Bonuses may be awards of bonus points or penalties of bonus points.

Each Mitcron begins playing the game for the first time (usually by playing Level 1) with a certain number of points (usually four). With these points a Mitcron may purchase as many Bots as he can. (SBs and RBs are usually, but not necessarily, purchased for one point each, giving each Mitcron at the beginning of the first level a total of four Bots.) At the end of the level the Mitcron is given a bonus that is added to or subtracted from the number of points present at the beginning of level, giving the Mitcron a new total of bonus points. The Mitcron may now, with his new sum of bonus points, purchase another supply of Bots for the next Level.

Different Bots, as noted above, may have different values because of different special powers; therefore, different Bots may have different prices. The prices assigned to each Bot may be created by the Mediator. Also, the scales of bonuses used to give out bonuses at the end of levels may be determined by the Mediator, so long as bonuses are given out and Bots are purchased according to the general rules above.

I claim:

1. A method for playing a mediated war game on at least three transparent sheets having identical geographical maps permanently affixed thereon, played by at least a first player using a first transparent play sheet having the original positions of at least a first and second game piece removably affixed thereon and by a second player using a second transparent play sheet having the original positions of at least a third and fourth game piece removably affixed thereon, and mediated by a mediator using a transparent master sheet having the original positions of the first, second, third and fourth game pieces removably affixed thereon, comprising:

1) ordering by the first player;
2) processing by the mediator of the first player's ordering;
3) ordering by the second player;
4) processing by the mediator of the second player's ordering; and
5) repeating steps 1 and 2 and steps 3 and 4 until a predetermined goal is reached by at least one player; wherein the ordering step by the first player comprises recording indicia on the first transparent play sheet to indicate to the mediator a new position for each of the first and second game pieces; and the ordering step by the second player comprises recording indicia on the second transparent play sheet to indicate to the mediator a new position for each of the third and fourth game pieces.

2. The method of claim 1 wherein processing the first player's ordering comprises superimposing the transparent master sheet over the first transparent play sheet and recording the new positions of the first and second game pieces to the master sheet from the first transparent play sheet and processing the second player's ordering comprises superimposing the transparent master sheet over the second transparent play sheet and recording the new positions of the third and fourth game pieces to the master sheet from the first transparent play sheet.

3. The method of claim 2 wherein processing additionally comprises erasing the original positions of the first and second game pieces from the first transparent play sheet and the master sheet and returning the first transparent play sheet to the first player following the recording of the new positions of the first and second game pieces on the master sheet and erasing the original positions of the third and fourth game pieces from the second transparent play sheet and the master sheet and returning the second transparent play sheet to the second player following the recording of the new positions of the third and fourth game pieces on the master sheet.

4. The method of claim 1 wherein the first player's ordering step is selected from the group of (a) recording indicia on the first transparent play sheet to indicate to the mediator a new position up to a predetermined distance from the original position for each of the first and second game pieces; and (b) recording indicia on the first transparent play sheet to indicate a target point for blasting; and the second player's ordering step is selected from the group of (d) recording indicia on the second transparent play sheet to indicate to the mediator a new position up to a predetermined distance from the original position for each of the third and fourth game pieces; and (e) recording indicia on the second transparent play sheet to indicate a target point for blasting.

5. The method of claim 4 wherein processing the first player's ordering comprises superimposing the transparent master sheet over the first transparent play sheet, recording the new positions of the first and second game piece positions on the master sheet from the first transparent play sheet, and erasing game pieces from the first transparent play sheet which are within a predetermined radius of the target point for blasting recorded by either the first or second player; and processing the second player's ordering comprises superimposing the transparent master sheet over the second transparent play sheet, recording the new positions of the third and fourth game piece positions on the master sheet from the first transparent play sheet, and erasing game pieces from the second transparent play sheet which are within a predetermined radius of the target point for blasting recorded by either the first or second player.

6. The method of claim 5 wherein processing by the mediator additionally comprises recording the position of the third game piece on the first transparent play sheet when the third game piece is within a predetermined radius of the at least one of the first player's game pieces, recording the position of the fourth game piece on the first transparent play sheet when the fourth game piece is within a predetermined radius of at least one of the first player's game pieces, recording the position of the first game piece on the second transparent play sheet when the first game piece is within a predetermined radius of at least one of the second player's game pieces, and recording the position of the second game piece when the second game piece is within a predetermined radius of at least one of the second player's game pieces.

7. The method of claim 6 wherein processing additionally comprises determining the legality of the first and second player's ordering by the mediator.

8. A method for playing a mediated war game on at least four transparent sheets having identical geographical maps permanently affixed thereon, played by at least a first player using a first transparent play sheet having the original positions of at least a first and second game piece removably affixed thereon, a second player using a second transparent play sheet having the original positions of at least a third and fourth game piece removably affixed thereon, and a third player using a third transparent play sheet having the original positions of at least a fifth and sixth game piece removably affixed thereon, and mediated by a mediator using a transparent master sheet having the original positions of the first, second, third, fourth, fifth and sixth game pieces removably affixed thereon, comprising:

1) ordering by the first player by recording indicia on the first transparent play sheet to indicate either a new position for each of the first and second game pieces or to indicate a target point for blasting;
2) processing by the mediator of the first player's ordering;
3) ordering by the second player by recording indicia on the second transparent play sheet to indicate either a new position for each of the third and fourth game pieces or to indicate a target point for blasting;
4) processing by the mediator of the second player's ordering;
5) ordering by the third player by recording indicia on the third transparent play sheet to indicate either a new position for each of the fifth and sixth game pieces or to indicate a target point for blasting;
6) processing by the mediator of the third player's ordering; and
7) repeating steps 1 and 2, 3 and 4, and 5 and 6 until a predetermined goal is reached by at least one player.

9. The method of claim 8 additionally comprising the forming of an alliance between at least two players.

10. The method of claim 1 wherein processing by the mediator additionally comprises (a) recording a displaced position for each game piece on both the master sheet and the player's play sheet wherein the displaced position is a function of the distance of each game piece from a predetermined point on the master sheet; and (b) erasing each of the game piece's previous positions from both the master sheet and the player's play sheet.

11. The method of claim 1 additionally comprising preparing a first written communication by the first player and then transferring the first written communication to the mediator to be given to the second player.

12. The method of claim 1 additionally comprising preparing a second written communication by the second player and then transferring the second written communication to the mediator to be given to the first player.

* * * * *